US008661567B1

(12) United States Patent
Hoover et al.

(10) Patent No.: US 8,661,567 B1
(45) Date of Patent: Mar. 4, 2014

(54) SWEAT MANAGEMENT SYSTEM

(76) Inventors: Michele M. Hoover, St. Petersburg, FL (US); Joseph Brooke Hoover, St. Petersburg, FL (US)

( * ) Notice: Subject to any disclaimer, the term of this patent is extended or adjusted under 35 U.S.C. 154(b) by 453 days.

(21) Appl. No.: 12/807,731

(22) Filed: Sep. 13, 2010

Related U.S. Application Data

(63) Continuation-in-part of application No. 12/384,226, filed on Apr. 2, 2009, now abandoned.

(51) Int. Cl.
*A41D 20/00* (2006.01)

(52) U.S. Cl.
USPC ..... 2/170

(58) Field of Classification Search
USPC ..... 602/20–23, 62, 63; 2/16, 170, 171, 162, 2/918, DIG. 11
See application file for complete search history.

(56) References Cited

U.S. PATENT DOCUMENTS

| | | | | |
|---|---|---|---|---|
| 4,832,010 | A * | 5/1989 | Lerman | 602/63 |
| 4,896,378 | A * | 1/1990 | Campana | 2/170 |
| 4,947,488 | A * | 8/1990 | Ashinoff | 2/181 |
| 5,329,638 | A * | 7/1994 | Hansen et al. | 2/16 |
| 6,425,137 | B1 * | 7/2002 | Fakhrai | 2/170 |

* cited by examiner

*Primary Examiner* — Tejash Patel

(57) ABSTRACT

An interior layer has inner and outer surfaces. The interior layer is fabricated of an elastic sweat transferring material. An exterior layer is positioned overlying the interior layer. The exterior layer has inner and outer surfaces. The exterior layer is fabricated of an elastic sweat transferring material. A chamber is formed between the interior layer and the exterior layer. An intermediate layer is provided within the chamber in pressure contact with the interior layer. The intermediate layer is fabricated of a sweat-trapping and containing material.

3 Claims, 7 Drawing Sheets

FIG 1
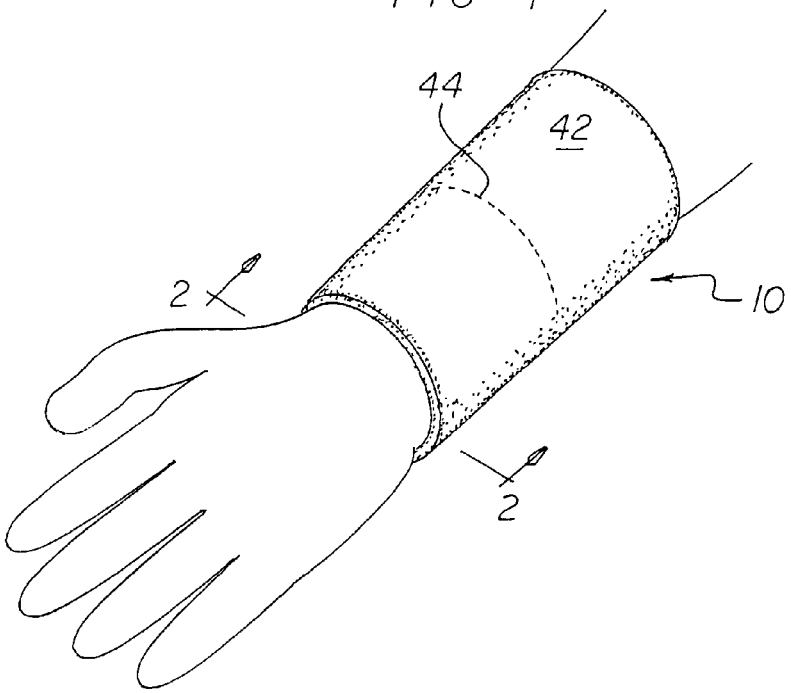
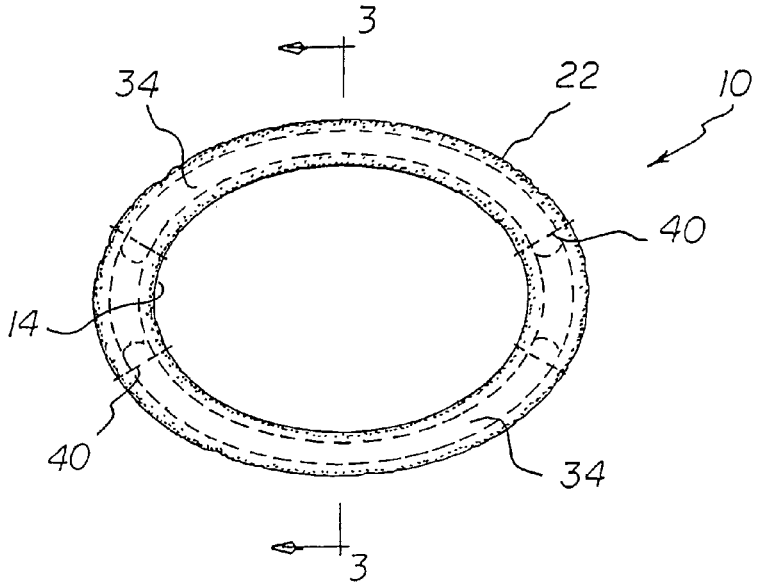
FIG 2

FIG 3
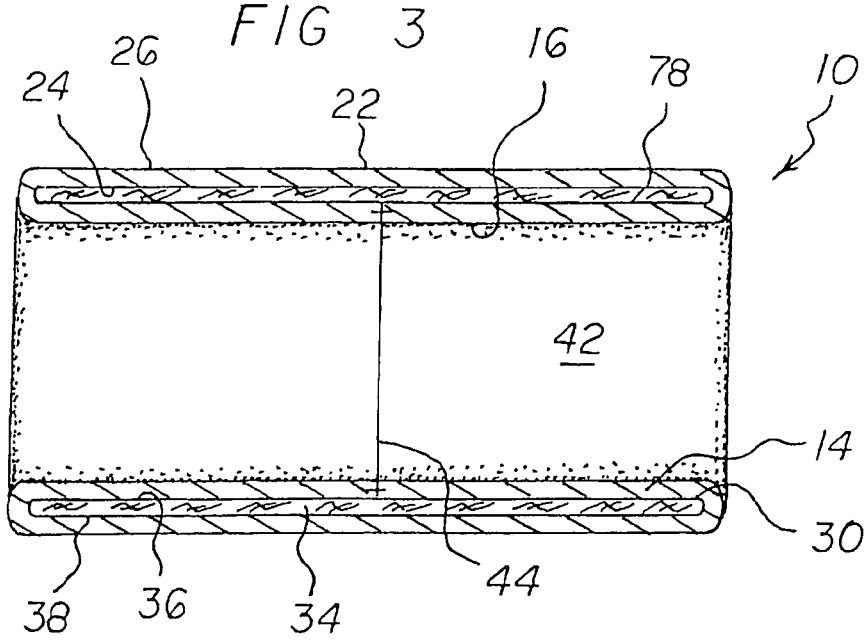
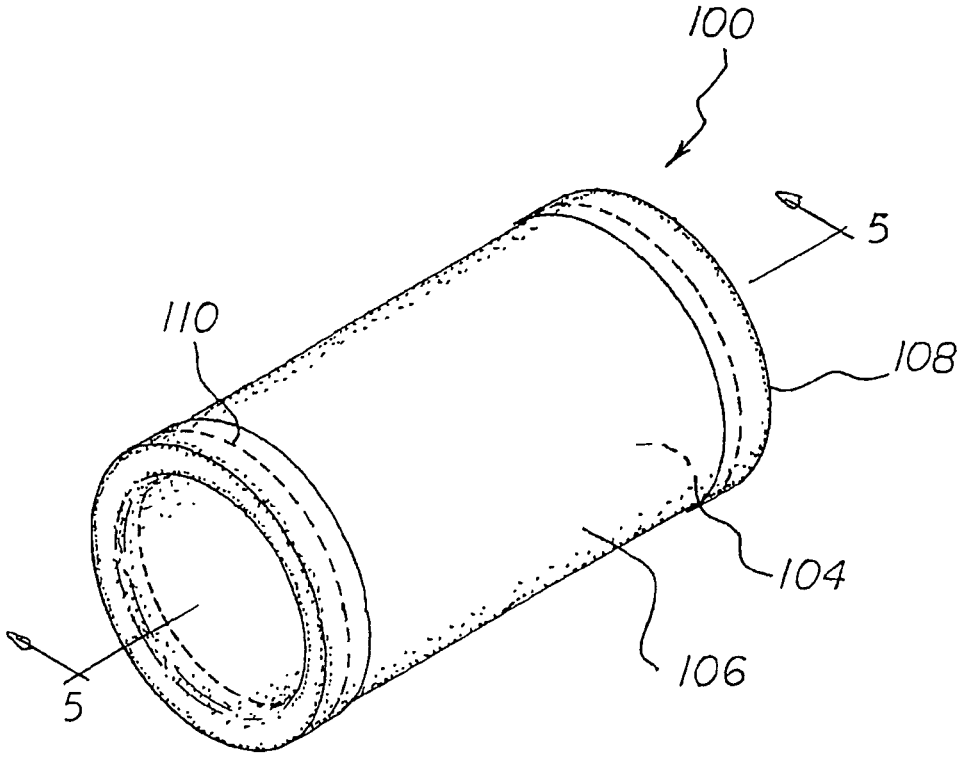
FIG 4

FIG 5
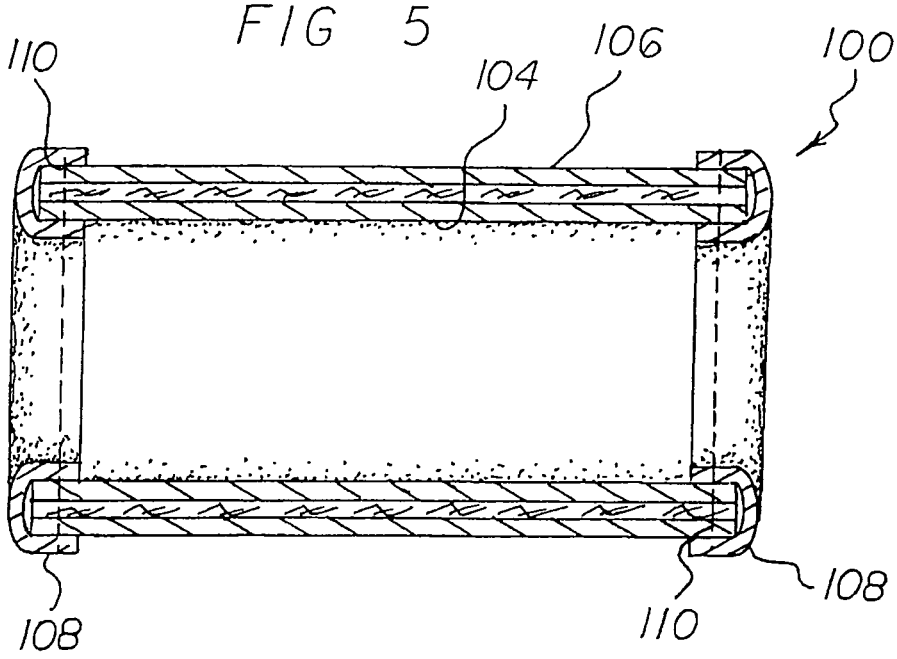
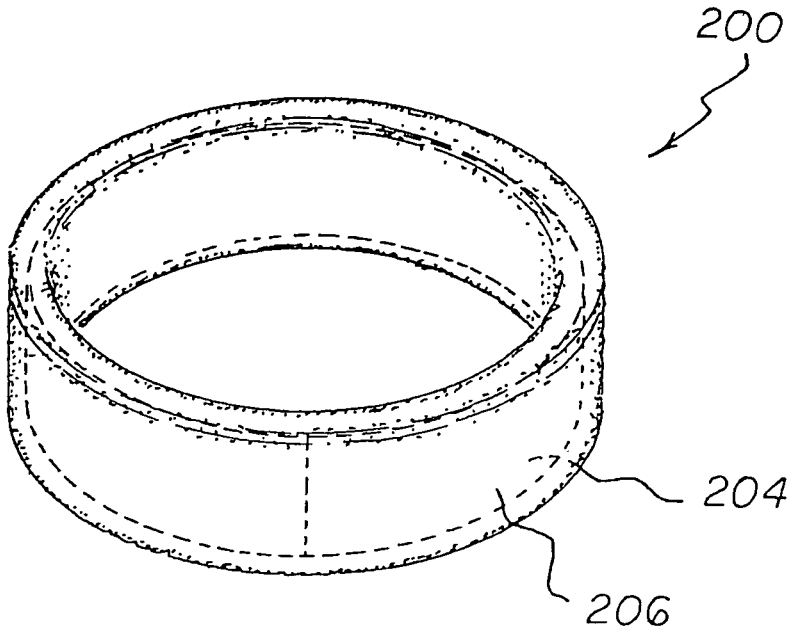
FIG 6

FIG 7
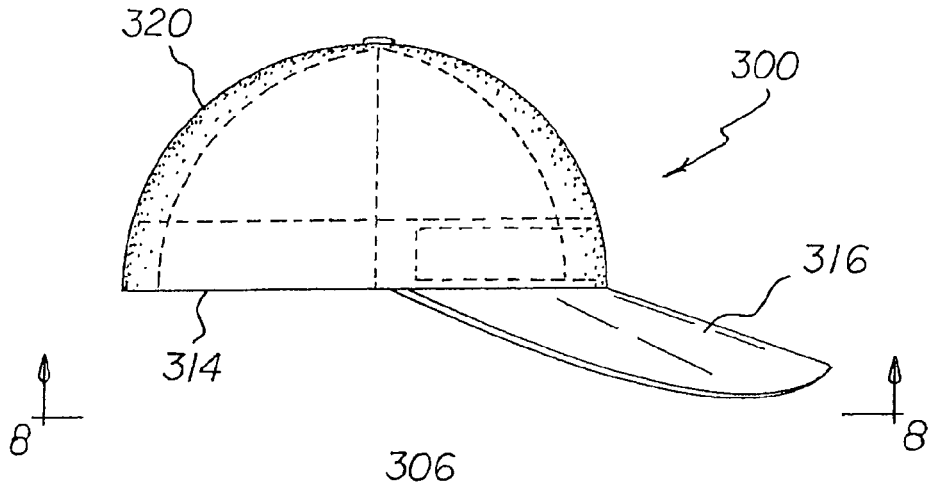
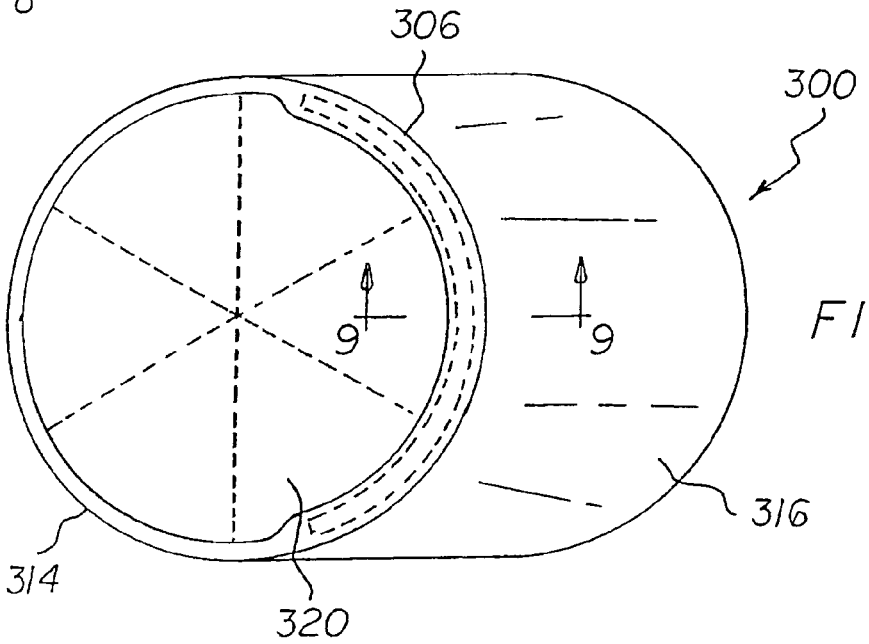
FIG 8
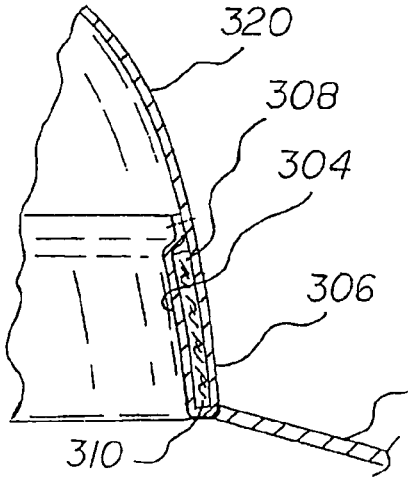
FIG 9

FIG 10
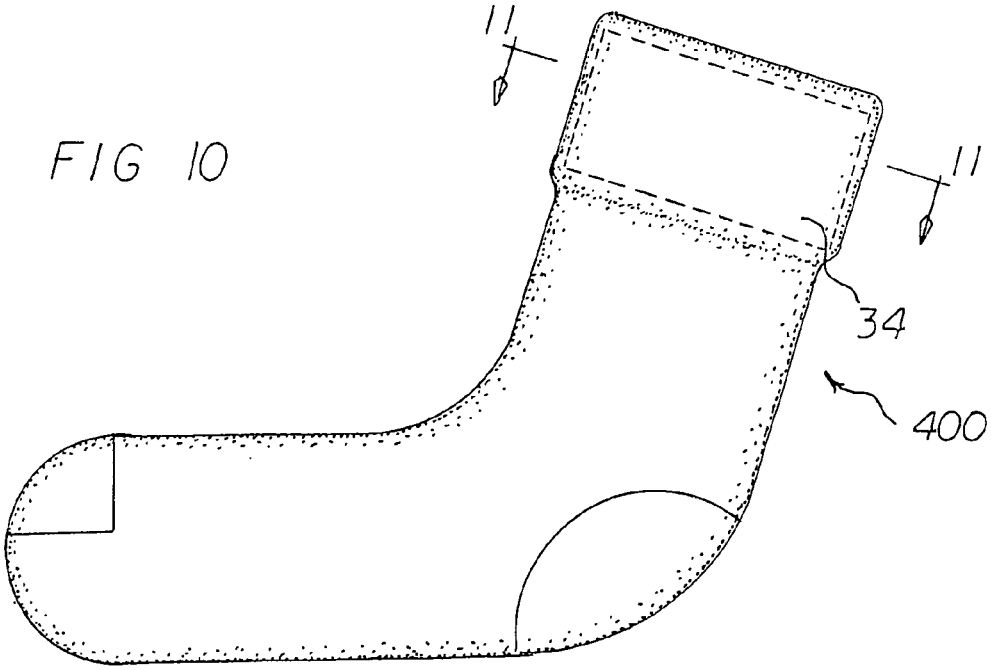
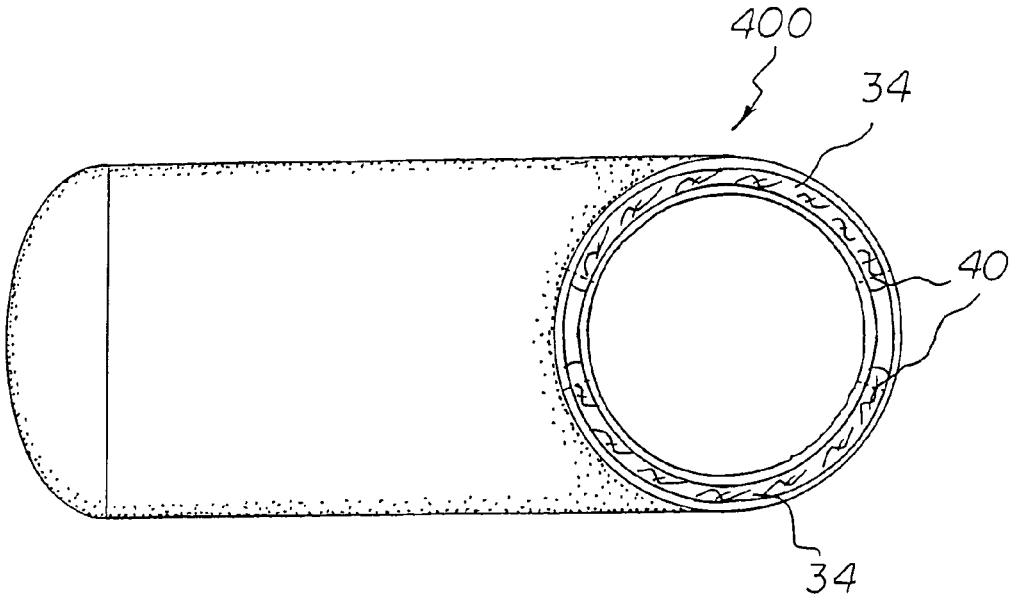
FIG 11

FIG. 12
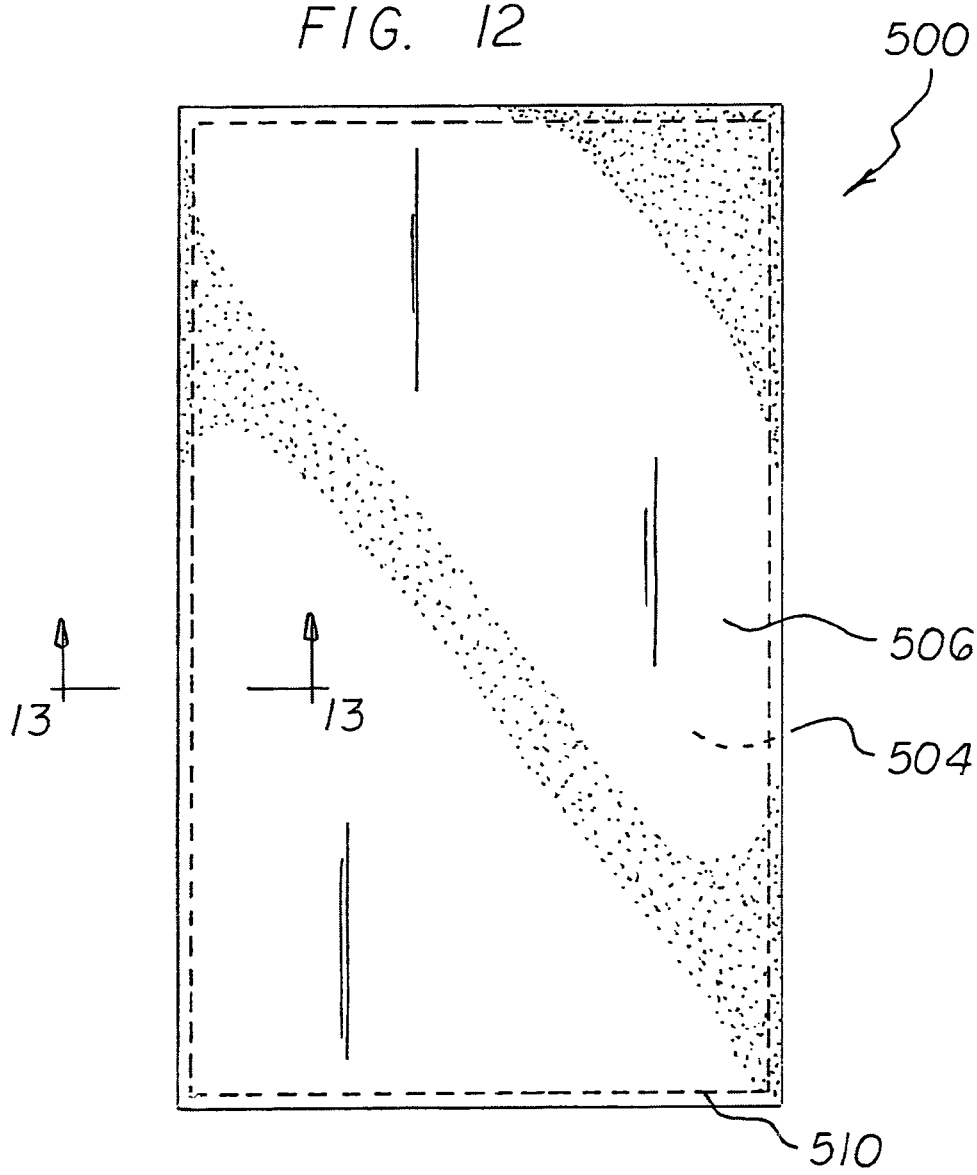
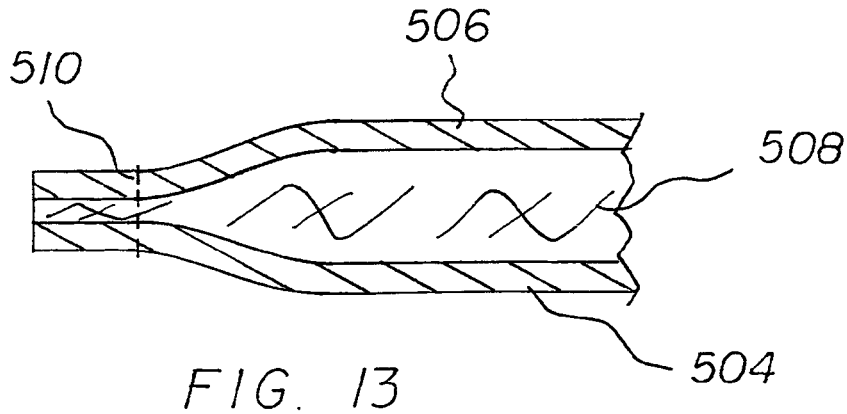
FIG. 13

FIG. 14
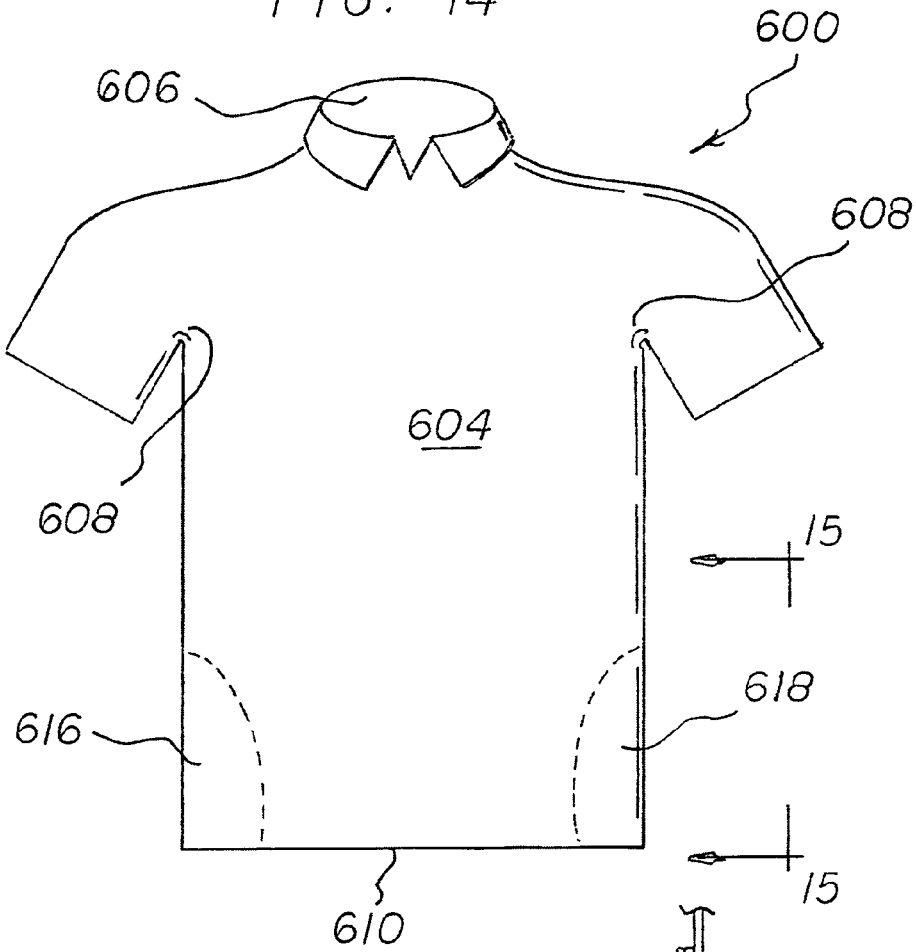
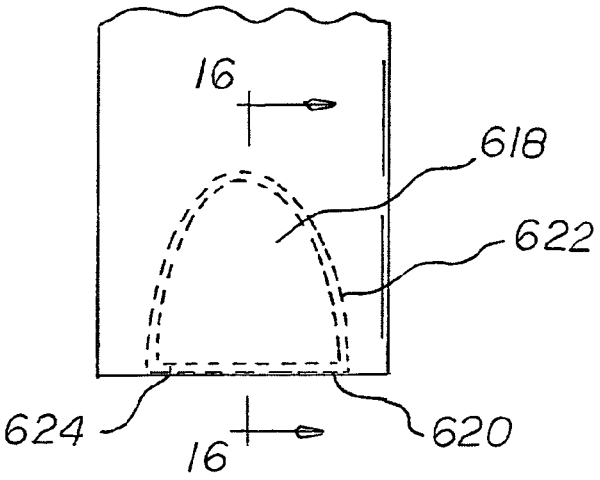
FIG. 15
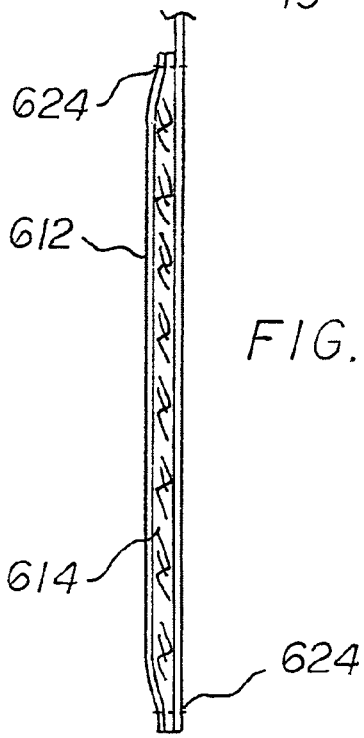
FIG. 16

SWEAT MANAGEMENT SYSTEM

RELATED APPLICATION

The present application is a continuation-in-part of U.S. patent application Ser. No. 12/384,226 filed Apr. 2, 2009 now abandoned, the subject matter of which is incorporated herein by reference.

BACKGROUND OF THE INVENTION

Field of the Invention

The present invention relates to a sweat management system and more particularly pertains to conducting sweat away from a user wearing the system and for trapping and containing such conducted sweat, the conducting and trapping and containing being achieved in a safe, convenient and economical manner.

SUMMARY OF THE INVENTION

In view of the disadvantages inherent in the known types of sweat management systems of known designs and configurations now present in the prior art, the present invention provides an improved sweat management system. As such, the general purpose of the present invention, which will be described subsequently in greater detail, is to provide a new and improved sweat management system and method which has all the advantages of the prior art and none of the disadvantages.

To attain this, the present invention essentially comprises a sweat management system. First provided is an interior layer. The interior layer has an inner surface. The inner surface is positionable in pressure-exerting contact with the wrist of the user, such as a tennis player. The interior layer has an outer surface. The outer surface is positionable out of contact with the wrist of the user, such as a tennis player. The interior layer is fabricated of an elastic sweat transferring material. The sweat transferring material includes about 80 percent polyester, about 10 percent nylon, and about 10 percent rubber. The interior layer is adapted to attract sweat away from the wrist of the user at a location adjacent to the inner surface of the interior layer. The interior layer is further adapted to conduct attracted sweat to a location adjacent to the outer surface of the interior layer.

An exterior layer is provided. The exterior layer is positioned overlying the interior layer. The exterior layer has an inner surface. The inner surface is adjacent to and faces toward the interior layer. The exterior layer has an outer surface. The outer surface faces away from the interior layer and is exposed to the atmosphere. The exterior layer is fabricated of an elastic sweat transferring material. The sweat transferring material includes about 80 percent polyester, about 10 percent nylon, and about 10 percent rubber. The term "about" used to identify the percentage of components in the layers is intended to mean the identified percentage plus or minus 10 percent of the identified amount. The exterior layer is adapted to transmit to the intermediate layer sweat generated by a user at locations other than locations contacted by the interior layer.

Provided next is a cylindrical chamber. The cylindrical chamber is formed between the interior layer and the exterior layer. The cylindrical chamber has an axial length and a circumference. The circumference is about the same length as the axial length.

Further provided is an intermediate layer. The intermediate layer is provided within the chamber. The intermediate layer has an inner surface. The inner surface is positioned in pressure contact with the interior layer. The intermediate layer has an outer surface. The outer surface is in contact with the exterior layer. The intermediate layer is fabricated of a sweat-trapping and containing material. The material includes 100 percent non-woven cellulose, preferably viscose rayon, a synthetic shammy material. The intermediate layer is adapted to receive sweat from the interior layer. The intermediate layer is adapted to trap and contain several times its weight in sweat. In this manner when a wearing the system generates sweat at the inner surface of the interior layer, the generated sweat will be trapped and contained in the intermediate layer. The intermediate layer has the capability to trap and contain up to 12 times its weight in sweat. In this manner the system is significantly more effective than known sweat management devices in keeping dry the wrist or other body part of the user. The intermediate layer is formed of two similar panels with stitching coupling the axial ends of each panel to the interior and exterior layers. Axial spacings between the panels with the spacings constituting between 5 and 15 percent of the circumference of the system. Such spacings allow for stretching of the system to facilitate putting on and taking off.

The interior layer and the exterior layer are fabricated of a single piece of fabric. The fabric is configured into a generally flat, torus-shaped common piece of fabric. The fabric has free ends. The free ends have stitching. The stitching joins the free ends. In this manner the chamber is formed in a generally cylindrical configuration. Also in this manner the intermediate layer is in a generally cylindrical configuration corresponding to the size and shape of the chamber.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sweat management system which has all of the advantages of the prior art sweat management systems of known designs and configurations and none of the disadvantages.

It is another object of the present invention to provide a new and improved sweat management system which may be easily and efficiently manufactured and marketed.

It is further object of the present invention to provide a new and improved sweat management system which is of durable and reliable constructions.

An even further object of the present invention is to provide a new and improved sweat management system which is susceptible of a low cost of manufacture with regard to both materials and labor, and which accordingly is then susceptible of low prices of sale to the consuming public, thereby making such sweat management system economically available to the buying public.

Even still another object of the present invention is to provide a sweat management system for conducting sweat away from a user wearing the system and for trapping and containing such conducted sweat, the conducting and trapping and containing being achieved in a safe, convenient and economical manner.

Lastly, it is an object of the present invention to provide a new and improved sweat management system. An interior layer has inner and outer surfaces. The interior layer is fabricated of an elastic sweat transferring material. An exterior layer is positioned overlying the interior layer. The exterior layer has inner and outer surfaces. The exterior layer is fabricated of an elastic sweat transferring material. A chamber is formed between the interior layer and the exterior layer. An intermediate layer is provided within the chamber in pressure contact with the interior layer. The intermediate layer is fabricated of a sweat-trapping and containing material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a sweat management system constructed in accordance with the principles of the present invention.

FIG. 2 is a cross sectional view taken along line 2-2 of FIG. 1.

FIG. 3 is a cross sectional view taken along line 3-3 of FIG. 2.

FIG. 4 is a perspective illustration of an alternate embodiment of the invention.

FIG. 5 is a cross sectional view taken along line 5-5 of FIG. 4.

FIG. 6 is a perspective illustration of another alternate embodiment of the invention.

FIG. 7 is a side elevational view of the next alternate embodiment of the invention.

FIG. 8 is a bottom view of the next embodiment taken along line 8-8 of FIG. 7.

FIG. 9 is a cross sectional view taken along line 9-9 of FIG. 8.

FIG. 10 is a side view of an additional alternate embodiment of the invention.

FIG. 11 is a cross sectional view taken along line 11-11 of FIG. 10.

FIG. 12 is a front elevational view of yet another embodiment of the present invention.

FIG. 13 is a cross sectional view taken along line 13-13 of FIG. 12.

FIG. 14 is a front elevational view a final alternate embodiment of the present invention.

FIG. 15 is a side elevational view taken along line 15-15 of FIG. 14.

FIG. 16 is a cross sectional view taken along line 16-16 of FIG. 15.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved sweat management system embodying the principles and concepts of the present invention and generally designated by the reference numeral 10 will be described.

The present invention, the sweat management system 10 is comprised of a plurality of components. Such components in their broadest context include an interior layer, an exterior layer, a chamber and an intermediate layer. Such components are individually configured and correlated with respect to each other so as to attain the desired objective.

First provided is an interior layer 14. The interior layer has an inner surface 16. The inner surface is positionable in pressure-exerting contact with the wrist of the user. The interior layer has an outer surface 18. The outer surface is positionable out of contact with the wrist of the user. The interior layer is fabricated of an elastic sweat transferring material. The sweat transferring material includes about 80 percent polyester, about 10 percent nylon, and about 10 percent rubber. The interior layer is adapted to attract sweat away from the user at a location adjacent to the inner surface of the interior layer. The interior layer is further adapted to conduct attracted sweat to a location adjacent to the outer surface of the interior layer.

An exterior layer 22 is provided. The exterior layer is positioned overlying the interior layer. The exterior layer has an inner surface 24. The inner surface is adjacent to and faces toward the interior layer. The exterior layer has an outer surface 26. The outer surface faces away from the interior layer and is exposed to the atmosphere. The exterior layer is fabricated of an elastic sweat transferring material. The sweat transferring material includes about 80 percent polyester, about 10 percent nylon, and about 10 percent rubber. The term "about" used to identify the percentage of components in the layers is intended to mean the identified percentage plus or minus 10 percent of the identified amount. The exterior layer is adapted to transmit to the intermediate layer sweat generated by a user at locations other than locations contacted by the interior layer.

Provided next is a cylindrical chamber 30. The cylindrical chamber is formed between the interior layer and the exterior layer. The cylindrical chamber has an axial length and a circumference. The circumference is about the same length as the axial length.

Further provided is an intermediate layer 34. The intermediate layer is provided within the chamber. The intermediate layer has an inner surface 36. The inner surface is positioned in pressure contact with the interior layer. The intermediate layer has an outer surface 38. The outer surface is in contact with the exterior layer. The intermediate layer is fabricated of a sweat-trapping and containing material. The material includes 100 percent non-woven cellulose, preferably viscose rayon, a synthetic shammy material. The intermediate layer is adapted to receive sweat from the interior layer. The intermediate layer is adapted to trap and contain several times its weight in sweat. In this manner when a user, such as a tennis player, wearing the system generates sweat at the inner surface of the interior layer, the generated sweat will be trapped and contained in the intermediate layer. The intermediate layer has the capability to trap and contain up to 12 times its weight in sweat. The system is thus significantly more effective than known sweat management devices in keeping dry the wrist, or other body part contacted, of the user. The intermediate layer is formed of two similar panels with stitching 40 coupling the axial ends of each panel to the interior and exterior layers. Axial spacings between the panels with the spacings constituting between 5 and 15 percent of the circumference of the system. Such spacings allow for stretching of the system to facilitate putting on and taking off.

The interior layer and the exterior layer are fabricated of a single piece of fabric 42. The fabric is configured into a generally flat, torus-shaped common piece of fabric. The fabric has free ends. The free ends have stitching 44. The stitching joins the free ends. In this manner the chamber is formed in a generally cylindrical configuration. Also in this manner the intermediate layer is in a generally cylindrical configuration with an oval cross sectional configuration corresponding to the size and shape of the chamber.

FIGS. 4 and 5 illustrate an alternate embodiment 100 of the invention. An interior layer 104 and exterior layer 106 are provided. The interior and exterior layers are fabricated from separate pieces of fabric. The interior and exterior layers include fabric end caps 108. The end caps have stitching 110. The stitching attaches the end caps to the layers and the layers to each other. The chamber has a cylindrical configuration. The chamber is formed between the interior layer and the exterior layer. The chamber has an axial length and a circumference. The circumference is about the same length as the axial length. In this manner the system is adapted to function as a wrist band.

The next alternate embodiment 200 is illustrated in FIG. 6. An interior layer 204 and exterior layer 206 are provided. The interior and exterior layers are fabricated from a single piece of fabric. The chamber is in a cylindrical configuration. The chamber is formed between the interior layer and the exterior layer. The chamber has an axial length and a circumference. The circumference is of a length greater than the axial length. In this manner system is adapted to function as a head band.

Reference is now made to the alternate embodiment 300 as illustrated in FIGS. 7, 8 and 9. An interior layer 304 and exterior layer 306 and the intermediate layer 308 are provided. The interior, exterior, and intermediate layers are fabricated in a generally rectangular configuration. A chamber 310 is provided. The chamber is a generally rectangular chamber. The chamber is formed between the interior layer and the exterior layer. The chamber has an axial length and a height. The axial length is between 2 and 4 times the height. In this manner the layers are positionable across the forehead of a wearer. Further in this manner the system is adapted to function as head wear.

In another alternate embodiment of the present invention a strap 314 is provided. The strap is coupled to and extends rearwardly from the layers. A bill 316 is provided. The bill is coupled to and extends forwardly from the layers. In this manner the system is adapted to function as a visor.

In another alternate embodiment of the present invention a crown 320 is provided. The crown extends upwardly from the layers and the strap. In this manner the system is adapted to function as a cap.

FIGS. 10 and 11 are perspective illustrations of another alternate embodiment 400 of the invention. In such embodiment the interior and exterior and intermediate layers are formed as in the prior embodiments. The layers, however, are formed with the top of a sock for functioning as an athletic sock.

System 500 is illustrated in FIGS. 12 and 13. In such embodiment, the interior and exterior layers 504, 506 and the intermediate layer 508 are fabricated of rectangular pieces of fabric. In addition, the interior and exterior layers and the intermediate layer all have a common height and a common width and a common periphery. The system further includes stitching 510 extending through the interior and exterior and intermediate layers in a rectangular configuration adjacent to the common periphery. In the preferred embodiment, the height is 24 inches and the width is 16 inches. The width is thus between 60 and 75 percent of the height.

The final alternate embodiment of the invention is illustrated in FIGS. 14, 15 and 16. In such system 600, the interior layer is a shirt 604. The shirt has a front and a back and sides. A neck opening 606 is above with laterally spaced arm openings 608 and a waist opening 610 below. The waist opening has a circumference. The exterior layer 612 and the intermediate layer 614 include a first side assembly 616 and a second side assembly 618. The exterior layers and intermediate layers of the first and second side assemblies have the same size and shape with a linear portion 616 below and an arcuate portion 618 above. The linear portion is between 10 and 25 percent of the circumference and the maximum height of the arcuate portion is between 40 and 50 percent of the vertical distance between the waist opening and an arm opening.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sweat management system comprising:

an interior layer having inner and outer surfaces, the interior layer being fabricated of a sweat transferring material;

an exterior layer positioned overlying the interior layer, the exterior layer having inner and outer surfaces, the exterior layer being fabricated of a sweat transferring material;

a chamber formed between the interior layer and the exterior layer; and an intermediate layer within the chamber in pressure contact with the interior layer, the intermediate layer having an inner surface positioned in pressure contact with the interior layer, the intermediate layer having an outer surface in contact with the exterior layer, the intermediate layer being fabricated of a sweat-trapping and containing material, the material including 100 percent non-woven cellulose, preferably viscose rayon, a synthetic shammy material, the intermediate layer adapted to transmit sweat from the interior layer to the intermediate layer for trapping and containing sweat from the wrist of the user wearing the system, the intermediate layer adapted to trap and contain several times its weight in sweat whereby when a user wearing the system generates sweat at the inner surface of the interior layer, the generated sweat will be trapped and contained in the intermediate layer, the intermediate layer having the capability to trap and contain up to 12 times its weight in sweat whereby the system is significantly more effective than known sweat management devices in keeping dry the wrist of the user.

2. A wrist band comprising:

an interior layer having inner and outer surfaces, the interior layer being fabricated of a sweat transferring material;

an exterior layer positioned overlying the interior layer, the exterior layer having inner and outer surfaces, the exterior layer being fabricated of a sweat transferring material;

a chamber formed between the interior layer and the exterior layer; and an intermediate layer within the chamber in pressure contact with the interior layer, the intermediate layer being fabricated of a sweat-trapping and containing material, the interior and exterior layers being fabricated from a single piece of fabric and the chamber being in a cylindrical configuration formed between the interior layer and the exterior layer, the chamber having an axial length and a circumference, the circumference being about the same length as the axial length whereby the system is adapted to function as a wrist band, the intermediate layer adapted to transmit sweat from the interior layer to the intermediate layer for trapping and containing sweat from the wrist of the user wearing the system, the intermediate layer adapted to trap and contain several times its weight in sweat whereby when a user wearing the system generates sweat at the inner surface of the interior layer, the generated sweat will be trapped and contained in the intermediate layer, whereby the system is significantly more effective than known sweat management devices in keeping dry the wrist of the user, the intermediate layer being formed of two similar panels with stitching coupling the axial ends of each panel to the interior and exterior layers, axial spacings formed between the panels with the spacings constituting between 5 and 15 percent of the circumference of the system.

3. A sweat management system for conducting sweat away from a wrist of a user wearing the system and for trapping and containing such conducted sweat, the system comprising, in combination:

an interior layer having an inner surface positionable in pressure-exerting contact with the wrist of the user, the interior layer having an outer surface positionable out of contact with the wrist of the user, the interior layer being fabricated of an elastic sweat transferring material including about 80 percent polyester, about 10 percent nylon, and about 10 percent rubber, the interior layer adapted to attract sweat away from the wrist of the user at a location adjacent to the inner surface of the interior layer and conduct such attracted sweat to a location adjacent to the outer surface of the interior layer;

an exterior layer positioned overlying the interior layer, the exterior layer having an inner surface adjacent to and facing toward the interior layer, the exterior layer having an outer surface facing away from the interior layer and exposed to the atmosphere, the exterior layer being fabricated of an elastic sweat transferring material including about 80 percent polyester, about 10 percent nylon, and about 10 percent rubber, the exterior layer being adapted to transmit sweat generated by a user at locations other than locations contacted by the interior layer;

a cylindrical chamber formed between the interior layer and the exterior layer, the cylindrical chamber having an axial length and a circumference, the circumference being about the same length as the axial length;

an intermediate layer within the chamber, the intermediate layer having an inner surface positioned in pressure contact with the interior layer, the intermediate layer having an outer surface in contact with the exterior layer, the intermediate layer being fabricated of a sweat-trapping and containing material, the material including 100 percent non-woven cellulose, preferably viscose rayon, a synthetic shammy material, the intermediate layer adapted to transmit sweat from the interior layer to the intermediate layer for trapping and containing sweat from the wrist of the user wearing the system, the intermediate layer adapted to trap and contain several times its weight in sweat whereby when a user wearing the system generates sweat at the inner surface of the interior layer, the generated sweat will be trapped and contained in the intermediate layer, the intermediate layer having the capability to trap and contain up to 12 times its weight in sweat whereby the system is significantly more effective than known sweat management devices in keeping dry the wrist of the user, the intermediate layer being formed of two similar panels with stitching coupling the axial ends of each panel to the interior and exterior layers, axial spacings formed between the panels with the spacings constituting between 5 and 15 percent of the circumference of the system; and the interior layer and the exterior layer being fabricated of a single piece of fabric configured into a generally flat, torus-shaped common piece of fabric having free ends with stitching joining the free ends, whereby the chamber is formed in a generally cylindrical configuration and whereby the intermediate layer is in a generally cylindrical configuration corresponding to the size and shape of the chamber.

* * * * *